United States Patent [19]

France

[11] Patent Number: 4,850,083

[45] Date of Patent: Jul. 25, 1989

[54] COTTON GIN RIB

[76] Inventor: L. D. France, P.O. Box 10112, Lubbock, Tex. 79408

[21] Appl. No.: 197,840

[22] Filed: May 24, 1988

[51] Int. Cl.[4] ..... D01B 1/08

[52] U.S. Cl. ..... 19/62 R

[58] Field of Search ..... 19/43, 55 R, 62 R

[56] References Cited

U.S. PATENT DOCUMENTS

| | | | |
|---|---|---|---|
| 3,369,275 | 4/1965 | Headley | 19/62 R |
| 3,694,857 | 10/1972 | Nayfa | 19/62 R |
| 3,943,604 | 3/1976 | Harrington et al. | 19/43 |
| 4,310,949 | 1/1982 | Vandergriff | 19/62 R |
| 4,463,479 | 8/1984 | Nayfa | 19/62 R |
| 4,625,365 | 12/1986 | Nayfa | 19/55 R |

*Primary Examiner*—Werner H. Schroeder
*Assistant Examiner*—D. Price
*Attorney, Agent, or Firm*—Wendell Coffee

[57] ABSTRACT

A tungsten carbide insert is attached into a cotton gin rib at the ginning point.

4 Claims, 1 Drawing Sheet

COTTON GIN RIB

RIGHTS TO INVENTIONS UNDER FEDERAL RESEARCH

There was no federally sponsored research and development concerning this invention.

BACKGROUND OF THE INVENTION (1) Field of the Invention

This invention relates to cotton gins, and more particularly to a cotton gin rib with a tungsten carbide insert attached at the ginning point.

(2) Description of the Related Art

Commercially, cotton is ginned by snagging locks of cotton upon the teeth of a rotating saw and pulling the lint between the ribs of the saw while preventing the seed from passing between the ribs.

It is known that the ribs wear because of the movement of the cotton fibers, seed, and other material upon the rib at this point.

McLean, in his U.S. Pat. No. 1,999,845; states that the rib could be hardened at the point of wear. It is assumed that this statement means case hardening. Also, Headly, U.S. Pat. Nos. 3,369,275; Nayfa 3,694,857; and Nayfa 4,463,479 disclose placing rollers at the ginning point.

SUMMARY OF THE INVENTION (1) Progressive Contribution to the Art

According to this invention a tungsten carbide insert is attaching to the rib at the ginning point by conventional braising. The insert is at the ginning point on the ribs so that locks of cotton upon the teeth contact the carbide insert instead of contacting the softer steel of the rib.

After it is inserted, the rib is polished by conventional abrading techniques so that the carbide insert is flush and smooth with the remainder of the rib. After the rib has been placed in service in the gin, the continued movement of the cotton, and particularly with the dust and dirt which may be therein, will continue to keep the area polished and smooth.

(2) Objects of this Invention

An object of this invention is to gin cotton.

Another object of this invention is to reduce the wear upon the gin rib.

Further objects are to achieve the above with devices that are sturdy, compact, durable, lightweight, simple, safe, efficient, versatile, ecologically compatible, energy conserving, and reliable, yet inexpensive and easy to manufacture, operate and maintain.

Other objects are to achieve the above with a method that is rapid, versatile, ecologically compatible, energy conserving, efficient, and inexpensive, and does not require highly skilled people to connect, adjust, operate, and maintain.

The specific nature of the invention, as well as other objects, uses, and advantages thereof, will clearly appear from the following description and from the accompanying drawing, the different views of which are not scale drawings.

Figure 2:
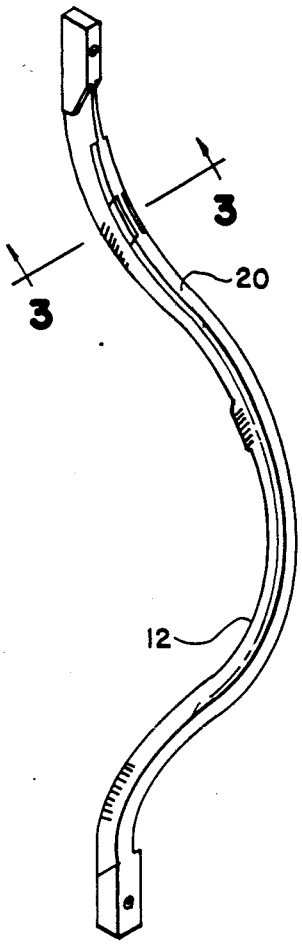
FIG. 2 is a perspective view of a rib according to this invention.
Figure 1:
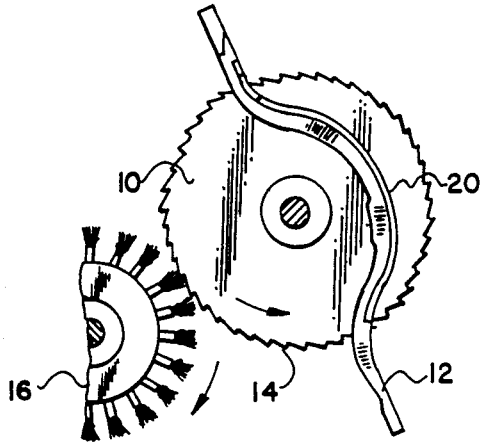
FIG. 1 is a side sectional view of some elements of a gin stand particularly showing the saw and the rib.
Figure 3:
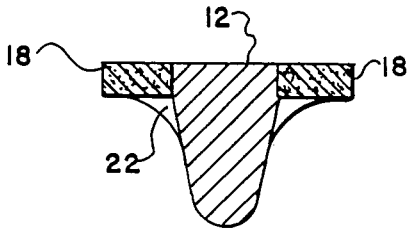
FIG. 3 is a cross sectional view taken substantially upon line 3—3 of FIG. 2.
Figure 4:
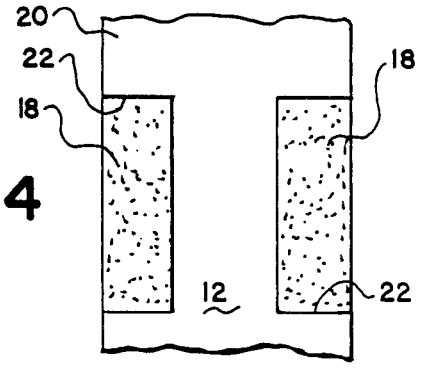
FIG. 4 is a front elevational view of the rib at the ginning point.

As an aid to correlating the terms of the claims to the exemplary drawing, the following catalog of elements and steps is provided:

10 saw
12 rib
14 teeth
16 brush
18 carbide insert
20 flange
22 notch

DESCRIPTION OF THE PREFERRED EMBODIMENT

Referring to the drawings, it may be seen represented, conventional gin saw 10 adapted to operate through ribs 12 to remove lint from seed and carry the lint to where it is doffed from teeth 14 of the saw 10 by brush 16. Inasmuch as gin stands have been known and commercially available on the market for many years, the entire gin stand showing the seed roll box and other associated equipment has not been illustrated inasmuch as this invention is concerned only with carbide insert 18 in the rib 12.

At the top edge of rib 12 (where the ginning point is), the edges of flange 20 of the rib are removed, forming notch 22 on either side of the rib. Carbide insert 18 is attached in the notch 22.

Tungsten carbide is the preferred material for the insert; however, other carbide materials which may be polished smooth may be used.

Attachment of carbide inserts into steel backings is well known. Particularly, it will be understood that carbide inserts are used in different metal cutting tools. Braising of such inserts is well known in the metal working field and the preferred attachment for this invention.

It will be understood that rather than using two carbide inserts, one on each side, a notch could be cut across the entire face of the gin rib and one single rectangular insert be inserted. However, since the wear is always at the ginning point where the saw teeth 14 pull the lint through the adjacent ribs, the additional carbide is of no benefit to the finished rib. The only benefit of using a single large piece of carbide is a slight simplification in the fabrication.

After the carbide insert is attached to the rib, the rib is ground or abraded so that the carbide insert is flush and smooth with the remainder of the rib.

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. In a cotton gin having:

a. ribs, flanges on each rib with ginning points on each flange b. a circular saw with c. teeth along the periphery thereof d. extending between the ribs, e. said teeth adjacent to a ginning point on the ribs, and f. means operatively associated with the saw for doffing lint therefrom, the improvement comprising in combination with the above g. a carbide insert in the flanges at the ginning point.

2. The invention as defined in claim 1, further comprising:

h. said carbide insert flush and smooth with the flanges at said ginning point.

3. The gin as defined in claim 1, wherein h. said carbide is tungsten carbide.

4. The method of preventing wear of cotton ginning ribs comprising:

a. attaching a tungsten carbide insert at a ginning point on flanges of the ribs, and b. abrading the attached insert so that the insert is flush and smooth at the ginning point on said flanges.

* * * * *